United States Patent [19]

Heuberger et al.

[11] Patent Number: 5,048,691

[45] Date of Patent: Sep. 17, 1991

[54] CONTAINER WITH AN INNER POUCH

[75] Inventors: Erich Heuberger, Trugenhofen; Wolf-Dieter Knörrich, Heidenheim, both of Fed. Rep. of Germany

[73] Assignee: Carl Edelmann GmbH, Heidenheim, Fed. Rep. of Germany

[21] Appl. No.: 492,466

[22] Filed: Mar. 13, 1990

[30] Foreign Application Priority Data

Jan. 18, 1990 [DE] Fed. Rep. of Germany ..... 9000528

[51] Int. Cl.[5] ..... B65D 5/46; B65D 5/54

[52] U.S. Cl. ..... 206/611; 220/403; 220/462; 220/465; 229/117.22; 229/117.24

[58] Field of Search ..... 229/125.14, 125.15, 229/162, 117.22, 117.24; 220/403, 404, 418, 461, 462, 465; 206/605, 611, 614

[56] References Cited

U.S. PATENT DOCUMENTS

| | | | |
|---|---|---|---|
| 2,640,645 | 6/1953 | Brown | 229/117.22 |
| 2,944,727 | 7/1960 | Moore | 229/162 |
| 3,169,690 | 2/1965 | Scholle | 220/403 |
| 3,233,817 | 2/1966 | Casady | 220/403 |
| 3,253,764 | 5/1966 | Goetschius et al. | 220/465 |
| 3,360,112 | 12/1967 | Johnson | 229/117.22 |
| 3,490,678 | 1/1970 | James et al. | 229/162 |
| 4,572,422 | 2/1986 | Heuberger et al. | 220/462 |

FOREIGN PATENT DOCUMENTS

| | | | |
|---|---|---|---|
| 860129 | 2/1961 | United Kingdom | 220/403 |

*Primary Examiner*—Gary E. Elkins

*Attorney, Agent, or Firm*—Nies, Kurz, Bergert & Tamburro

[57] ABSTRACT

A container with an inner pouch includes an outer cardboard shell with interconnected bottom and top flaps and a leakproof inner pouch with a closeable spout. The outer shell in its front side wall has an inwardly inclined upper portion provided with an orifice for the spout, and in its two lateral side walls has triangular, folded-in sections adjacent the inclined portion of the front side wall. The spout projects through a wall of the pouch and has a flange at the inner end which is secured to the interior surface of the pouch. At least one tear-off strip is located in at least one side wall of the outer shell, which, upon removal, permits the plastic inner pouch to be effortlessly removed from the shell.

10 Claims, 1 Drawing Sheet

CONTAINER WITH AN INNER POUCH

BACKGROUND OF THE INVENTION

This invention refers to a container with an inner pouch, particularly for liquids or bulk goods or the like, consisting of an outer cardboard shell of the type used in folding boxes, with bottom and top flaps connected, particularly glued, together, and further consisting of a leakproof inner pouch closed at its upper and/or lower ends by a sealed or welded seam and having a closable spout extending through an orifice in one of the side walls of the cardboard shell.

Containers with inner pouches as described above are already known. Relative to containers consisting entirely of plastic, which they are to replace, they have the advantage of being environmentally safer. Nevertheless, they consist of two materials, namely an outer cardboard shell and an inner pouch of plastic foil. To be sure, substantially less plastic must be used for the pouch than in containers solely of plastic; however, the latter is not desirable in ordinary household garbage.

OBJECT OF THE INVENTION

The object of the invention is to design the already known container in a more environmentally positive manner, and in particular to make it possible simply to remove the plastic pouch from the cardboard shell when disposing of the empty containers, to enable the waste to be sorted into separate bins according to material in a simple manner. As the closed cardboard shells are relatively sturdy and the inner pouch is usually glued to the inner wall of the cardboard shell over a relatively large area, measures are to be proposed by which easy and simple separation of the container parts without the aid of tools is made possible.

For the solution of this problem it is suggested to provide at least one tear-off strip in at least one of the side walls of the cardboard shell, such a strip being described by two parallel perforated lines facilitating the pulling off of the tear-off strip such that upon its removal an opening is or can be created which is large enough to enable one to reach into the interior of the cardboard shell to grasp the inner pouch and extract it from the cardboard shell without particularly strenuous effort.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings, in which.

DETAILED DESCRIPTION OF THE DRAWINGS

Figure 1:
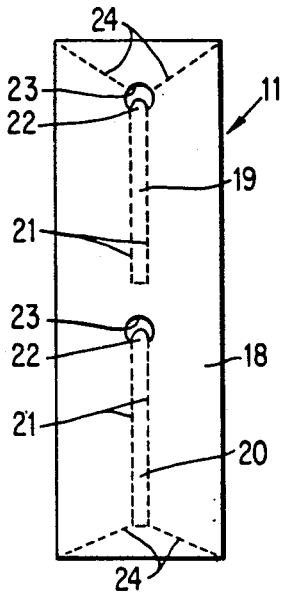
FIG. 1 shows a plan view of the rear narrow side wall of a container with an inner pouch according to the invention, opposite the front side wall containing the spout.

The container in question, designed in accordance with the invention, consists of an outer cardboard shell 11 and an inner pouch 12. The one narrow front side wall 13 has an orifice 14 in its upper end, with a spout 16, secured to the inner pouch 12 by means of a flange 15 and closable by a screw-on cap 17, projecting the spout through said orifice. Seen in FIG. 1, the rear side wall 18 opposite the narrow front side wall 13 containing the spout 16 has, in its middle, two tear-off strips 19 and 20 arranged one above the other and laterally described by two parallel perforated lines 21. Tabs 22, projecting into a cutout 23, are disposed at the upper end of the tear-off strips 19 and 20, so that either or both strips can easily be grasped by hand to enable them to be effortlessly removed from the cardboard of the rear side wall 18.

It is advantageous, depending on the height of the container, to provide several tear-off strips to be removed successively from top to bottom according with the level of contents of the container, so that, if a transparent inner pouch 12 is used, windows formed in this way can reveal how much of the contents still remains in the container. Such a subdivision of the tear-off strip into several parts arranged one above the other or strips separated from one another offers the advantage that the container retains more stability as long as the lower tear-off strips have not yet been removed from the side wall. With progressive emptying of the container, stability in the upper region is no longer necessary.

If the container is completely empty, the outer cardboard shell 11 can be effortlessly torn open at the rear side wall 18, in order for the inner pouch to be extracted and the container parts consisting of different materials to thereby be separated. The tearing open of the rear side wall 18 can be facilitated by additional perforations 24, extending for instance from opposite ends of the perforated lines 21 to the corners of the container.

For the complete and effortless removal of the tear-off strips 19 and 20 from the side wall 18 of the outer cardboard shell 11, a foil strip is adhered to to the inner side of each length of tear-off strip (19 and 20), said foil strips being sufficiently strong to guarantee that the edges of the window formed upon the removal of the tear-off strips 19, 20 are substantially sharp and straight.

Figure 2:
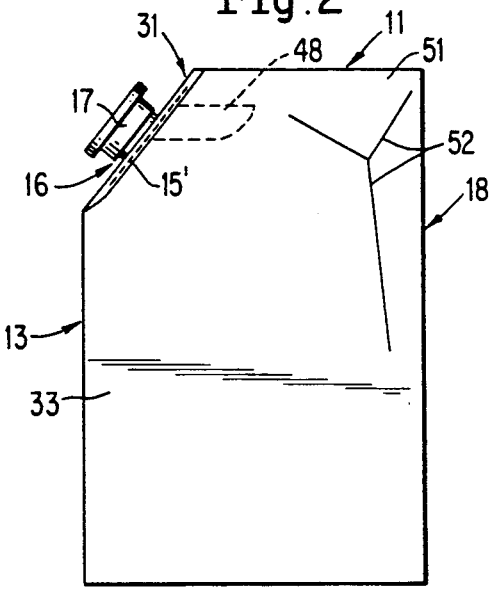
FIG. 2 shows a lateral side view of a container with an inner pouch.
Figure 3:
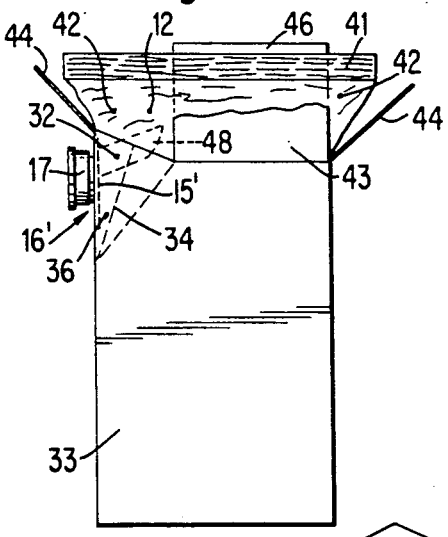
FIG. 3 shows a lateral side view of the container according to FIG. 2 in a not yet closed state.
Figure 4:
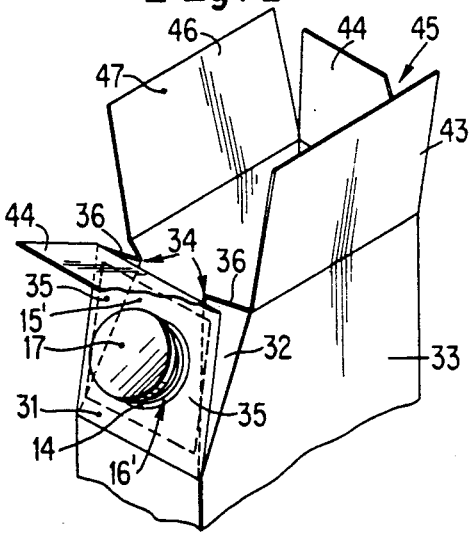
FIG. 4 shows a perspective partial view of the container open at the top, without the inner pouch, but with a spout inserted for demonstration purposes.

A container with inner pouch, such as the one shown in FIGS. 2 to 4, have a special form to the extent that the upper part 31 of the narrow front wall 13 is backwardly inclined, so that the spout 16 located in this part lies together with its cap 17 within the effective, projected contours of the box-shaped container. The advantage of this is that a plurality of containers of the same type can be stacked in close juxtaposition in a shipping case, since there is virtually no dead space between the containers.

Containers with inner pouches of the type described above are formed by folding the upper triangular wall portions 32 of the two wider side walls 33, adjacent to the inclined upper side wall portion 31, inwardly along their bisectors 34 and then gluing them together. In containers of this type it can be unnecessary to glue the inner pouch 12 to the interior wall of the cardboard shell, particularly in the vicinity of the spout 16, which hampers easy removal of the inner pouch 12 from the cardboard shell. This adhesion can be avoided if a spout 16' is used which is provided with a flange 15' (see FIGS. 2, 3 and 4) attached to the inner pouch and extending across the width of the wall portion 31, so that the lateral edges 35 thereof can be clamped between the wall portion 31 and the bordering triangular gusset 36 of the adjacent side walls 33. In this way it is sufficiently guaranteed that the spout 16' is held in position relative to the cardboard shell 11. The removal of the inner pouch from the container is rendered substantially easier by this constructional feature.

Clamping the inner pouch in the area of the top and correspondingly in the area of the bottom of the container instead of gluing further serves to facilitate the removal of the inner pouch from the container. For this purpose, the parts 42 in the inner pouch 12 which contain the upper pouch seam 41 in the inner pouch 12 are clamped between the lower, larger top flap 43 and the two smaller top flaps 44 overlapping said top flap 43, with one corner 45 of said smaller flaps 44 being cut off. The larger top flap 46 finally covers the two smaller top flaps 44 and is glued along its free edge 47 to the lower large top flap 43, to provide a secure and stable closure of the box. Because the inner pouch 12 is not glued to the outer cardboard shell 11 in the areas in question, the pouch can be more easily extracted from the cardboard shell.

Finally, it has proven to be advantageous if a skirt 48 projecting into the interior of the inner pouch 12 is provided on the flange 15 carrying the spout 16, said skirt supporting the upper adjacent portion 42 of the inner pouch 12 no longer glued to the cardboard shell, so that the pouch can not block the orifice of the spout 16 in an undesirable manner.

In order to improve the handling capability of the containers in question with larger volumes, i.e. to enable such generally heavier containers to be held more easily while being emptied, score lines 52 are to be provided in the larger side walls 33 in the area of the upper rear corners 51, so that the cardboard wall can be easily and slightly pressed inwardly at this place, whereby the hand holding the container finds a better grip. For this reason, the container then can not slip so easily out of the hand, something which occasionally occurs with heavier containers.

Figure 5:
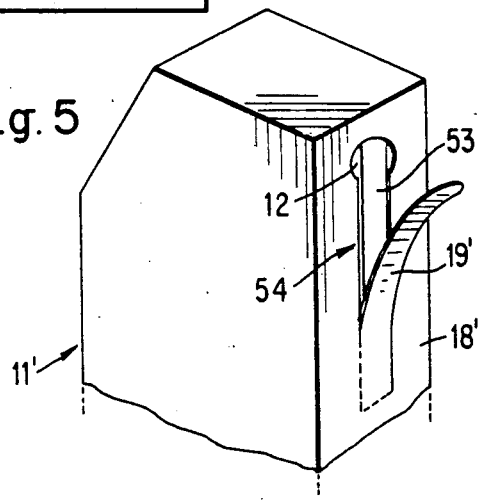
FIGS. 5 and 6 each show a perspective partial view of the rear wall of two respective variations of the container according to FIGS. 2 to 4.

As FIG. 5 shows, particularly in larger containers, it can be advantageous to provide a handle 53 below the upper tear-off strip 19' in the narrow rear wall 18' of the container, consisting of a band folded at one end to enable it to lie flat, with this handle capable of being pulled outwardly upon removal of the tear-off strip 19' from the rear wall 18', through the window 54 thereby formed, to then serve as a carrying grip. The ends of the band forming the handle or carrying grip 53 are secured to the inner side of the rear wall 18' of the cardboard shell 11'. When the handle 53 is pulled out, the level of the contents in the transparent pouch 12' can be viewed nonetheless through the window 54.

Figure 6:
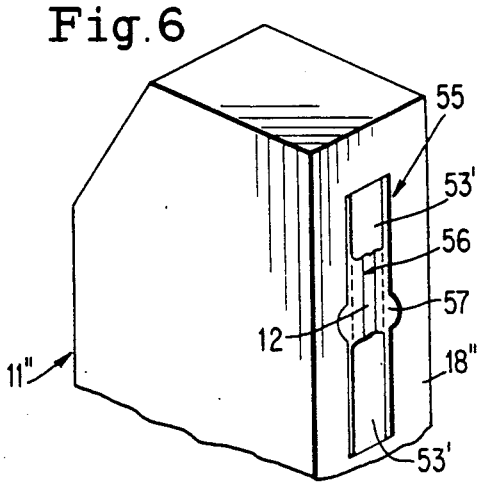

In one variation of this embodiment according to FIG. 6, a window 55 can be provided at the place at which the tear-off strip 19 is located, with the directly accessible handle or carrying grip 53' lying flat behind said window. If applicable, the handle or grip can be backed on the inner side of the rear wall 18'' by a cover sheet 57 with a strip-like viewing window 56. For practical purposes, the handle 53' would then be wider than the viewing window 56, to cover the same until the carrying grip 53' has been pulled out.

What is claimed is:

1. A container for goods, such as goods from the group of goods consisting of liquid goods and bulk goods, comprising: an outer cardboard shell; and a leakproof inner pouch; said cardboard shell comprising a folding box with four side walls consisting of one set of opposed front and rear side walls and one set of opposed lateral side walls, said side walls having bottom flaps and top flaps, said top flaps being folded and connected, as by glue, to form a top for said box, said bottom flaps being folded and connected, as by glue, to form a bottom for said box, and an orifice provided in the front side wall; said inner pouch having wall portions with top and bottom ends, both ends of which are closed, at least the top end of the pouch wall portions being closed by a sealed seam, and a closeable spout secured in a said wall portion of said inner pouch and extending through said orifice in said front side wall; at least one of said side walls including at least one tear-off strip defined by two parallel perforated lines located in said at least one of said side walls, and also included in said at least one side wall is at least one additional perforated line which adjoins and extends from at least one of said two parallel perforated lines.

2. A container with an inner pouch as defined in claim 1, wherein a plurality of tear-off strips (19, 20) are disposed vertically in tandem in said at least one of the side walls.

3. A container with an inner pouch as defined in claim 1, wherein a plastic foil strip is glued to said at least one tear-off strip (19, 20) on the inner side of the cardboard box to provide a backing for said at least one tear-off strip.

4. A container with an inner pouch as defined in claim 1, wherein an upper portion of said front side wall contains said orifice for the spout connected to the inner pouch, said upper portion being inwardly inclined when the container shell is closed, and upper portions of said lateral side walls having triangular portions adjoining the inclined upper front side wall portion, each triangular portion having an apex and a base and having its apex facing down and located at the joinder between the associated lateral side wall and the front side wall and its base located along the top of the associated lateral side wall, each said triangular portion having a fold line made along the bisector from its apex to its base enabling each said triangular portion to be folded inwardly along its bisector and glued together; and wherein said spout (16') has a flange (15') located inside of and secured to an interior surface of the inner pouch, said flange extending essentially across the width of the front wall upper portion (31) containing the orifice for the spout (16'), said flange having lateral edge portions clamped between said front upper wall portion (31) and the adjoining folded and glued triangular portions (36) of adjacent lateral side walls (33).

5. A container with an inner pouch as defined in claim 1, wherein the wall portions (42) of the top end of the inner pouch (12) containing said sealed seam (41) are clamped between a first folded over lateral side wall top flap (43) and two front and rear side wall top flaps (44) folded over and overlapping said first lateral side wall top flap, said front and rear side wall top flaps, each having one corner (45) cut off and, after being folded over, being covered by the other lateral side wall top flap (46) which is folded over and glued along its edge (47) to said first lateral side wall top flap (43).

6. A container with an inner pouch according to claim 1, wherein said spout (16') has an entry opening with an integral flange around the entry opening located inside of and secured to an interior surface of said inner pouch 12, said flange including an integral skirt (48) within and projecting into the pouch and providing support for the inner pouch foil wall portions adjacent the flange (15) and entry opening of the spout (16).

7. A container with an inner pouch as defined in claim 2, wherein said tear-off strips are located in said rear side wall and a flatly folded, handle (53) consisting of a band secured to the interior surface of said rear side wall (18') is provided under the upper-most one of said vertically disposed tandem tear-off strips (19') in said rear side wall (18'), with said handle band capable of being pulled into the form of a bow through a window (54) opened through said rear side wall by removing said upper-most tear-off strip (19').

8. A container as defined in claim 1, wherein an elongated, vertical window (55) is provided in an upper area of said rear side wall (18''), and behind said window a flatly folded handle (53') is provided and comprises a band secured to the interior surface of the rear side wall (18''), said handle band being capable of being pulled out through said elongated window (55) to the outside in the form of a bow, and a cover sheet (57) provided with a viewing window (56) being mounted against the container interior surface adjacent said elongated window and backing said band.

9. A container as defined in claim 2, wherein a portion of said side wall which includes said plurality of tear-off strips separates each adjacent two of said tandem tear-off strips.

10. A container as defined in claim 1, including a plurality of additional perforated lines and a different one of said additional perforated lines extends from at least one of the ends of each of said parallel perforated lines.

* * * * *